United States Patent [19]

Steiner

[11] Patent Number: 4,854,351

[45] Date of Patent: Aug. 8, 1989

[54] CONTACT BAR FOR THE WARP STOP MOTION

[75] Inventor: Ernst Steiner, Richterswil, Switzerland

[73] Assignee: Grob & Co. Akt., Richterswil, Switzerland

[21] Appl. No.: 178,219

[22] Filed: Apr. 6, 1988

[30] Foreign Application Priority Data

Apr. 7, 1987 [DE] Fed. Rep. of Germany ..... 3711597

[51] Int. Cl.[4] ..... D03D 51/30

[52] U.S. Cl. ..... 139/353

[58] Field of Search ..... 139/353, 359, 368; 200/61, 118

[56] References Cited

U.S. PATENT DOCUMENTS 3,324,899 6/1967 Stagg ..... 139/353

FOREIGN PATENT DOCUMENTS 190480 10/1980 Fed. Rep. of Germany .

3210333 10/1983 Fed. Rep. of Germany .

626 1/1988 World Int. Prop. O. ..... 139/353

*Primary Examiner*—Henry S. Jaudon

*Attorney, Agent, or Firm*—Watson, Cole, Grindle & Watson

[57] ABSTRACT

The contact bar comprises an outer bar having a U-shaped cross-section and a plurality of bar portions located therein and separated therefrom by an insulating layer. The bar portions are insulated against each other by intermediate insulating layers in partition planes extending laterally as well as parallel to the longitudinal edge. The bar portions are produced suitably by a punching out of a bar such that they, when fitted into each other, will supplement themselves again to a bar such that a shorter bar portion cut proceeding from the upper longitudinal edge of a longer bar portion fits into the longer bar portion. The longer bar portion is at the side facing the end of the contact bar, at which only the connecting contact for a power source is located is considerably narrower than at the opposite side where the drop wires will contact the bar portion upon a yarn breakage. The bar portion which are fitted into each other have, therefore, their connecting contacts located at the ends of the contact bars and a connection leading therefrom to a separately located optical annunciator device is provided, which device displays in which at the bar portions which are insulated against each other a drop wire has led to the triggering of the stopping of the machine.

5 Claims, 2 Drawing Sheets

CONTACT BAR FOR THE WARP STOP MOTION

BACKGROUND OF THE INVENTION

1. FIELD OF THE INVENTION

The present invention relates to a contact bar of textile machines, including a plurality of bar shaped bodies extending parallel to each other, which bar shaped bodies are insulated against each other and are connected to a power source and extend collectively through the contact slots of a plurality of drop wires arranged on the warp ends, which bar shaped bodies are insulated against each other and will be connected electrically by a drop wire upon a break of a warp end such to trigger a stopping of the machine, of which bar shaped bodies one is divided in longitudinal direction thereof into portions which are electrically insulated against each other allowing a localizing of the drop wire which triggered the stopping of the machine in one of the mentioned portions.

2. DESCRIPTION OF THE PRIOR ART

The bar shaped bodies of known apparatuses of this kind for the electrical warp stop motion consist of an outer bar having a U-shaped cross-section and an inner bar located therewithin in an insulated manner which, however, is divided into portions which are electrically insulated against each other. The outer bar is connected to the one pole of a power source and the portions of the inner bar which are insulated against each other are connected in parallel to the other pole of the power source via a main line and a series of distribution points as well as the branch lines which are branched off thereof. A control lamp is located at every respective bar partition area between adjacent portions and the lamps are respectively connected electrically to the adjoining distribution points, whereby due to the electrical circuit the two lamps at the ends of mentioned portion will be illuminated upon a drop of the drop wire onto said portion such that a detection can be made of that portion where which a warp has broken. An apparatus of this kind is disclosed in the German Utility Model DE-GM No. 80 10 814.

In a further apparatus of this kind as disclosed in the German Patent Specification DE-PS No. 32 10 333 the monitoring lamps allocated to the individual partition areas of the bar portions are not connected to parallel, there rather are provided light emitting diodes bridging the partition areas and connected electrically in series. Furthermore, a partition area and an allocated light emitting diode are located at the begin of the bar, such that the drop of a drop wire in this section, too, may be detected by the illumination of the first diode.

The drawback of these known apparatuses is the necessity of providing connections for lines to the control lamps or light emitting diodes, resp. at all partition area between the portions of the bar. In view of the rough operation of a textile mill and of the vibrations which the equipment for the warp stop motion must experience the arranging of lamps or light emitting diodes along a plurality of contact bars, having a length of several meters and located adjacent of and parallel to each other in an apparatus for the warp stop motion is quite unsuitable. If the light emitting diodes or the lamps are not installed directly above the contact bar but rather at a different location, it is necessary to lead lines from all bar portions and bridging the partition areas to the light emitting diodes located at a more distant or better protected, resp. location. Lines leading from the individual bar portions form also no advantageous solution, they rather cause such an apparatus or arrangement, resp. to be still more prone to disturbances.

SUMMARY OF THE INVENTION

Hence, it is a general object of the present invention to provide a bar which is divided into mutually insulated portions which is insensible to the rough operation encountered in a textile mill and is designed as to its structure such that the bar portions arranged subsequentially and insulated in the longitudinal direction of the contact bar have their connecting points at the end of the contact bar. These connecting points may then be connected to annunciators located instantly therefrom and can be located not in the immediate surrounding of the machine or above the machine, but rather at a distance or at a suitable location within the field of vision of the operator, whereby the annunication can be accomplished in various ways including a digital display.

A further object is to provide a contact bar in which at least two bar portions are received in one outer bar forming a bar shaped body and having a U-shaped cross-section, which at least two bar portions are formed by a separating from a bar parallel partition planes proceeding from its longitudinal edge and extending at a mutual distance laterally and longitudinally in an edge parallel fashion, which bar portions are insulated against each other along said partition planes, fit into each other and supplement each other to a bar shaped structure and are insulated against said U-shaped outer bar.

By separating an originally rectilinear bar having a constant cross-section in its longitudinal extent into bar portions located deck-wise above each other and which fit into each other such to supplement each other to the original shape, whereby the separating is done preferably by punching, an extremely rugged contact bar structure is arrived at in a most easy way, which is suitable for the rough environment of a textile mill, and in which the bar portions located remote from the ends of the bar have their connection points located at the end of the bar.

Yet a further object of the invention is to provide such a contact bar in which the at least two bar portions extend preferably along one half of the length of the contact bar, and in which a substantially homologous arrangement of at least two bar portions extends along the other half of the contact bar. Quite obviously a bar may be separated by a correspondingly larger number of parallel separating cuts into more than two bar portions fitting into each other, which is applicable for both contact bar halves in case of a homologous design, i.e. it is possible to provide in accordance with a preferred embodiment without any further ado still more bar portions of similar shape, located decks-wise above each other and fitting into each other, such that in case of a homologous design totally not only four but rather six or eight bar portions are present in each contact bar half.

BRIEF DESCRIPTION OF THE DRAWINGS

The present invention will be more fully understood by reference to the following detailed description thereof, when read in conjunction with the attached drawings, and wherein.

DETAILED DESCRIPTION OF THE PREFERRED EMBODIMENT

Figure 1:
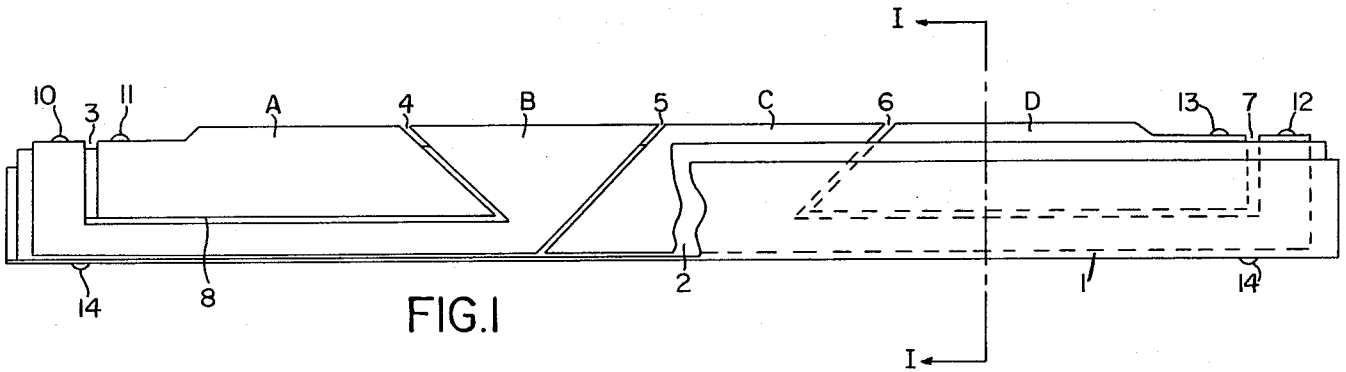
FIG. 1 is a side view of a contact bar.
Figure 2:
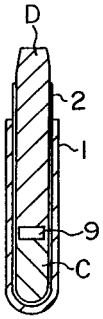
FIG. 2 is a cross-section of the contact bar of FIG. 1 along line I—I thereof.

The contact bar illustrated in FIGS. 1 and 2 consists of an outer bar 1 having a U-shaped cross-section and which extends along the entire contact bar length, of an insulating layer 2 having the same length by means of which the U-shaped outer bar is clad, and of a plurality of bar portions A, B, C and D which together form the inner bar. In FIG. 1 the outer bar 1 and the insulating layer 2 are illustrated partly broken away such to render the bar portions forming the inner bar visible at the left hand side of FIG. 1. The bar portions A, B, C and D are produced by a dissecting of a bar shaped body, preferably by punching cuts. The bar portions are separated from each other by partition planes 3, 4, 5, 6 and 7 proceeding laterally from a longitudinal edge and which do not run completely through and by partition planes 8 and 9 extending parallel to the edge and are insulated against each other by an insulating intermediate layer located in these partition planes. The dissecting of the bar portions has thereby been made such that they supplement each other again to a bar shaped body. The bar portions A fits into the bar portion B and the bar portion D fits into the bar portion C. The partition planes between the bar portions are located such that the bar portion B which adjoins at both ends the bar portion A is substantially narrower at the side facing the end of the contact bar than at the opposite side. The connecting contact 10 for the connection of the rail portion B to a power source is located at the end of the narrow zone. The connection contact for the bar portion A is located directly adjacent thereof, but separated by the insulating partition plane 3. The bar portion A and B extend along one half of the length of the contact bar and the other half thereof is taken up by the two bar sections C and D, and the connection contact 12 of the bar portion D is also located close to the end of the contact bar in the substantially homologous arrangement.

In case of correspondingly more partition planes and more than two bar portions set into each other on each contact bar half, the contact bar can be divided into more than totally four bar portions. The drop wires which are not illustrated in the drawing will not come into contact with the zones of the bar portions located at the two ends of the contact bar of which the upper edge is located somewhat lower at the connection contacts 10-13. In order to definitely establish a contact and to prevent a drop wire from catching in one of the laterally extending partition planes 4, 5 or 6 these partition planes 4, 5 and 6 extend at an angle obliquely to the longitudinal edge of the bar. This design incorporates, furthermore, the advantage that bending forces have less influence on the contact bar.

Figure 3:
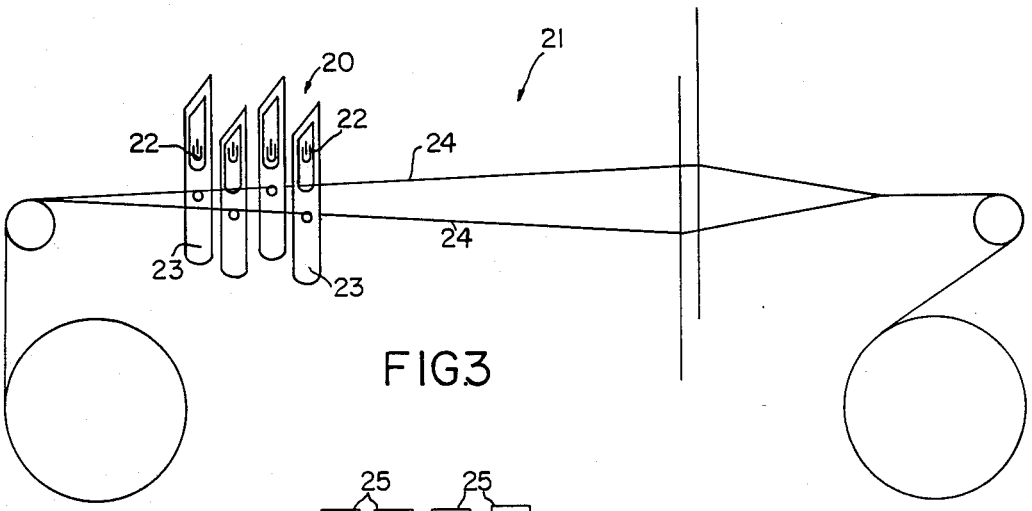
FIG. 3 is a side view showing schematically the warp ends in a textile machine and four contact bars of a warp stop motion device with drop wires hanging from the warp ends.
Figure 4:
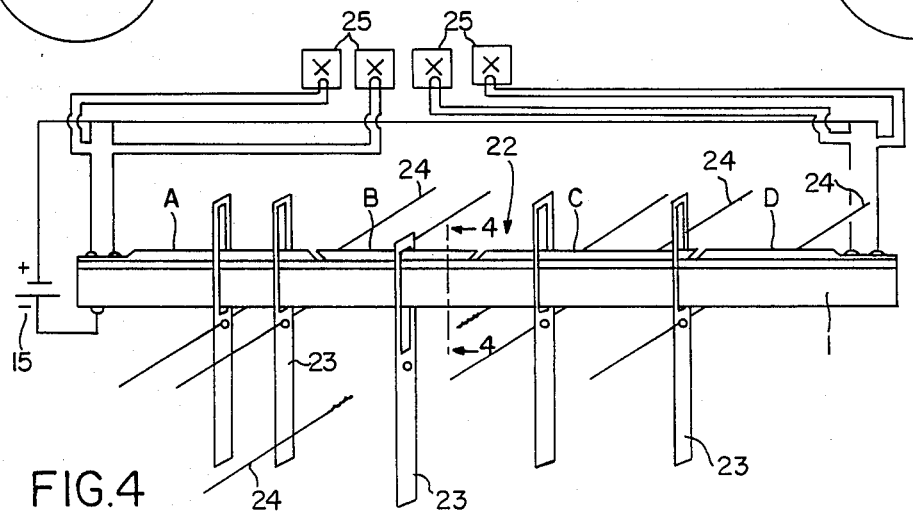
FIG. 4 is a side view of one contact bar with drop wires and the associated warp ends.
Figure 5:
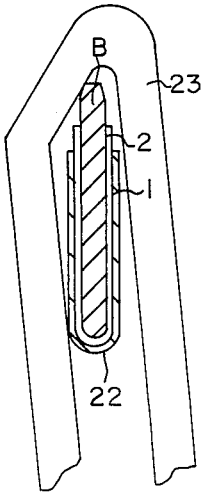
FIG. 5 is a cross-section of the contact bar of FIG. 4 along line 4—4, in an enlarged scale with a drop wire (partly broken away) causing electrical connection between inner and outer bar of the contact bar.

The outer bar 1 having a U-shaped cross-section is connected via the connection contact 14 to one of the poles of the power source 15, and the bar portion A, B, C and D are connected via the connecting contacts 10–13 to the other pole thereof. According to the well known operation regarding the electrical warp stop motion device 20 of a textile machine 21 of FIG. 3, while the device has, for example, four contact bars 22 (see also FIG. 5), the drop wire 23 dropping onto the contact bar upon a brake of a warp end 24, the inner bar portions B (FIG.4) will be connected in an electrically conducting fashion to the outer bar, (shown in FIG. 5 at an enlarged scale) such that the stopping of the machine is triggered. By means of the indicating means as (FIG. 4) which can be structured in accordance with any of the various known designs such as a lamp it, thereafter, is possible to detect on which of the bar portions A, B, C or D a drop wire rests on the contact bar 22 due to a yarn breakage, such that the broken yarn can be found and repaired faster.

While there is shown and described a present preferred embodiment of the invention, it is to be distinctly understood that the invention is not limited thereto, but may be otherwise variously embodied and practiced within the scope of the following claims.

I claim:

1. A contact bar adapted for use in an electrical warp stop motion device of a textile machine, said bar comprising two electrical conductive carriers extending parallel and being insulated from each other, and adapted to project as one assembly through contact slots of numerous drop wires of the warp stop motion device which are hanging from warp ends in the textile machine, said carriers capable of coming into electrical connection in the event of a breakage of one warp end by means of the associated drop wire which results, due to the electrical connection, in a switch being tripped which consequently stops the textile machine, wherein one of said carriers is a U-profile outer bar and the inner carrier which fits into said U-profile outer bar comprises at least two parts which are shaped for complementary intermeshing with one part being arranged in the other part, so as to for together a longitudinally extending structure in which the top edges of the parts are adjacent and in a straight line and which parts are separated along partition planes extending parallel to the top edge of the inner part and in a transverse direction and being insulated from each other along said partition planes and from the U-profile outer bar surrounding the parts thereby allowing a detecting of a drop wire of the stop motion device which drops on one of said parts in the event of a breakage of one warp end, which parts are electrically connected with indicating instruments.

2. The contact bar of calim 1, wherein the one part of the inner carrier which adjoins at both ends the other part fitting thereinto is in its area at the side facing said outer carrier end which is intended for the connection to the power source substantially narrower than in its area at the opposite side which is intended to be contacted by the drop wires.

3. The contact bar of claim 1, in which two parts of the inner carrier extend along, at least one half of the length of the contact bar, and two further parts extending along the other half of the length of the contact bar are arranged in a substantially homologous arrangement.

4. The contact bar of claim 1, in which the entire length of the inner carrier is devided into a plurality of parts fitting into each other which are all substantially narrow at the side facing the same carrier end than at the side intended to be contacted by the drop wires and are arranged therebetween deck-wise above each other.

5. The contact bar of claim 1, in which the transversely extending partition planes which in the area intended to be contacted by drop wires separate the parts of the inner carrier and extend at an angle obliquely relative to the longitudinal top edge, and in which all parts of the inner carrier adjoin each other in the longitudinal direction of the contact bar in an insulated manner of their obliquely extending partition planes.

* * * * *

UNITED STATES PATENT AND TRADEMARK OFFICE

CERTIFICATE OF CORRECTION

PATENT NO. : 4,854,351

DATED : August 8, 1989

INVENTOR(S) : Ernst Steiner

It is certified that error appears in the above-identified patent and that said Letters Patent is hereby corrected as shown below:

In the title page, correct the name and address of the Assignee to read --Grob & Co. Aktiengesellschaft--

Signed and Sealed this

Thirtieth Day of October, 1990

*Attest:*

HARRY F. MANBECK, JR.

*Attesting Officer*

*Commissioner of Patents and Trademarks*